US005487492A

United States Patent [19]

Goulet

[11] Patent Number: 5,487,492

[45] Date of Patent: Jan. 30, 1996

[54] ICE COOLED BEVERAGE DISPENSER HAVING AN INTEGRAL CARBONATOR

[75] Inventor: Douglas P. Goulet, Big Lake, Minn.

[73] Assignee: IMI Cornelius Inc., Anoka, Minn.

[21] Appl. No.: 339,849

[22] Filed: Nov. 15, 1994

Related U.S. Application Data

[63] Continuation of Ser. No. 29,073, Mar. 10, 1993, Pat. No. 5,368,198, which is a continuation-in-part of Ser. No. 936, 153, Aug. 26, 1992, abandoned.

[51] Int. Cl.[6] ..... B67D 5/00

[52] U.S. Cl. ..... 222/129.1; 222/146.6; 261/DIG. 7; 62/57; 62/393

[58] Field of Search ..... 222/129.1, 129.2, 222/129.3, 146.1, 146.6; 261/DIG. 7, 140.1, 153; 62/59, 43, 4435, 393, 400

[56] References Cited

U.S. PATENT DOCUMENTS

| | | | |
|---|---|---|---|
| 3,511,415 | 5/1970 | Crowe | 222/146.1 |
| 4,555,371 | 11/1985 | Jeans | 261/DIG. 7 |
| 4,651,538 | 3/1987 | Bull et al. | 62/400 |
| 4,804,112 | 2/1989 | Jeans | 222/146.6 |
| 5,033,645 | 7/1991 | Shannon et al. | 222/146.6 |
| 5,080,261 | 1/1992 | Green | 222/146.6 |
| 5,209,069 | 5/1993 | Newnan | 222/146.6 |
| 5,226,296 | 7/1993 | Kolvites et al. | 222/146.6 |
| 5,228,312 | 7/1993 | Williams | 222/129.1 |
| 5,249,710 | 10/1993 | Hassell et al. | 222/146.6 |
| 5,319,947 | 6/1994 | Fischer | 222/146.6 |
| 5,335,819 | 8/1994 | Martin | 222/129.1 |
| 5,343,716 | 9/1994 | Swanson et al. | 222/146.6 |
| 5,350,086 | 9/1994 | Martin et al. | 222/129.1 |
| 5,353,958 | 10/1994 | Hawkins | 222/146.6 |

*Primary Examiner*—Andres Kashnikow
*Assistant Examiner*—Lisa Douglas
*Attorney, Agent, or Firm*—Sten Erik Hakanson

[57] ABSTRACT

The dispenser herein has a cold plate forming a bottom of an ice retaining bin. A bin liner is formed of two parts, a flat carbonator and a remaining U-shaped sheet metal wall structure. The carbonator and sheet metal structure when secured together form the bin liner, which, in turn, is secured to and around a perimeter edge of the cold plate and extends upward therefrom. In particular, the carbonator includes a flange integral therewith and extending from a portion of a perimeter edge thereof. A portion of the flange extends along the bottom of the carbonator for securing thereof to the cold plate, and further flange portions extend along opposite vertical carbonator edges for securing to corresponding vertical edges of the bin liner sheet metal portion. In an alternate embodiment a flat container is retained within a vertical portion of an L-shaped cold plate. A bin liner is secured to a horizontal portion of the cold plate and to the vertical portion thereof for forming an ice retaining bin.

11 Claims, 10 Drawing Sheets

10
2
30
44
32
29
42
34
20
38
22
23
42b
42a
16
2
22
18
42
21
18
16
42
12
43

ICE COOLED BEVERAGE DISPENSER HAVING AN INTEGRAL CARBONATOR

The present application is a continuation of U.S. patent application Ser. No. 08/029,073, filed Mar. 10, 1993, now U.S. Pat. No. 5,368,198, which was a continuation-in-part of U.S. patent application Ser. No. 07/936,153, filed Aug. 26, 1992, now abandoned.

BACKGROUND

1. Field of the Invention

The present invention relates generally to ice cooled beverage dispensers, and more particularly, to ice cooled beverage dispensers having a carbonator within an ice retaining bin thereof.

2. Background of the Invention

Carbonators are well known in the art, and provide for combining water and carbon dioxide for the production of carbonated water. Such carbonators are typically used in beverage dispensing devices wherein the carbonated water they produce is combined in a post-mix beverage dispensing valve with a syrup for production of a carbonated beverage. Ice cooled beverage dispensing machines generally provide for cooling of the liquid drink constituents through the use of a cold plate cooled by a volume of ice. Heretofore, it has been known to submerge the carbonator in the ice bin of a cold plate device. A draw back therewith concerns the lost volume of the ice bin interior volume devoted to the carbonator. Since carbonators are pressurized to provide for the carbonating of the water, they are typically a cylindrical pressure vessel. As a result thereof, the carbonator can significantly detract from the size of the ice bank or the volume of ice held in the particular beverage dispenser.

Therefore, it would be desirable to have an ice cooled beverage dispenser having an integral carbonator that does not greatly compromise the volume of ice that can be contained in the ice retaining bin thereof.

SUMMARY OF THE INVENTION

In one embodiment the present invention includes a low profile or flat carbonator for use in an ice cooled beverage dispensing device. The carbonator includes a front and a rear half, each separately cold drawn from a suitable sheet metal stock. Each half includes a plurality of alternating seams and ridges, and is secured to the other around their respective perimeters and along each seam. The seams do not extend the entire length of the carbonator, thus, the joined halves define an enclosed perimeter volume area and a plurality of enclosed column areas. The column areas are in fluid communication with the perimeter volume and are defined by the ridges of both halves. A top edge of the tank includes fittings for a pressure relief valve, a carbon dioxide inlet, a water inlet, and a level sensor. A plurality of carbonated water lines are equally spaced along and extend from a bottom edge of the carbonator tank. In particular, each carbonated water line extends upwardly, closely adjacent one of the halves of the carbonator and up and over the carbonator top edge.

In one embodiment of the dispenser of the present invention a flat cold plate forms a bottom of an ice retaining bin. A bin liner is formed of two parts, the flat carbonator and a remaining U-shaped sheet metal wall structure which together form a four sided bin liner. In particular, a portion of the carbonator perimeter includes a flange integral therewith and extending therefrom. A portion of the flange extends along the bottom of the carbonator and to the cold plate and further flange portions extend along opposite vertical carbonator edges for securing to corresponding vertical edges of the bin liner sheet metal portion.

In a further embodiment of the present invention an L-shaped cold plate having a horizontal portion and a vertical portion is used. An ice retaining volume is formed of a U-shaped sheet metal wall structure secured to the L-shaped cold plate. Specifically, the wall structure has a bottom edge secured to a perimeter edge of a top surface of the cold plate horizontal portion. In addition, the wall structure includes two vertical edges secured to corresponding vertical edges of an inner surface of the cold plate vertical portion. A flat carbonator is retained within the cold plate vertical portion.

It can be appreciated that the flat carbonator acts as one vertical "wall" of the bin liner, or is retained therein, and in this manner detracts a minimal amount from the ice containing capacity of the dispenser.

DESCRIPTION OF THE DRAWINGS

A further understanding of the structure and operation, objects and advantages of the present invention can be had by referring to the following detailed description which refers to the following figures, wherein.

DETAILED DESCRIPTION

Figure 1:
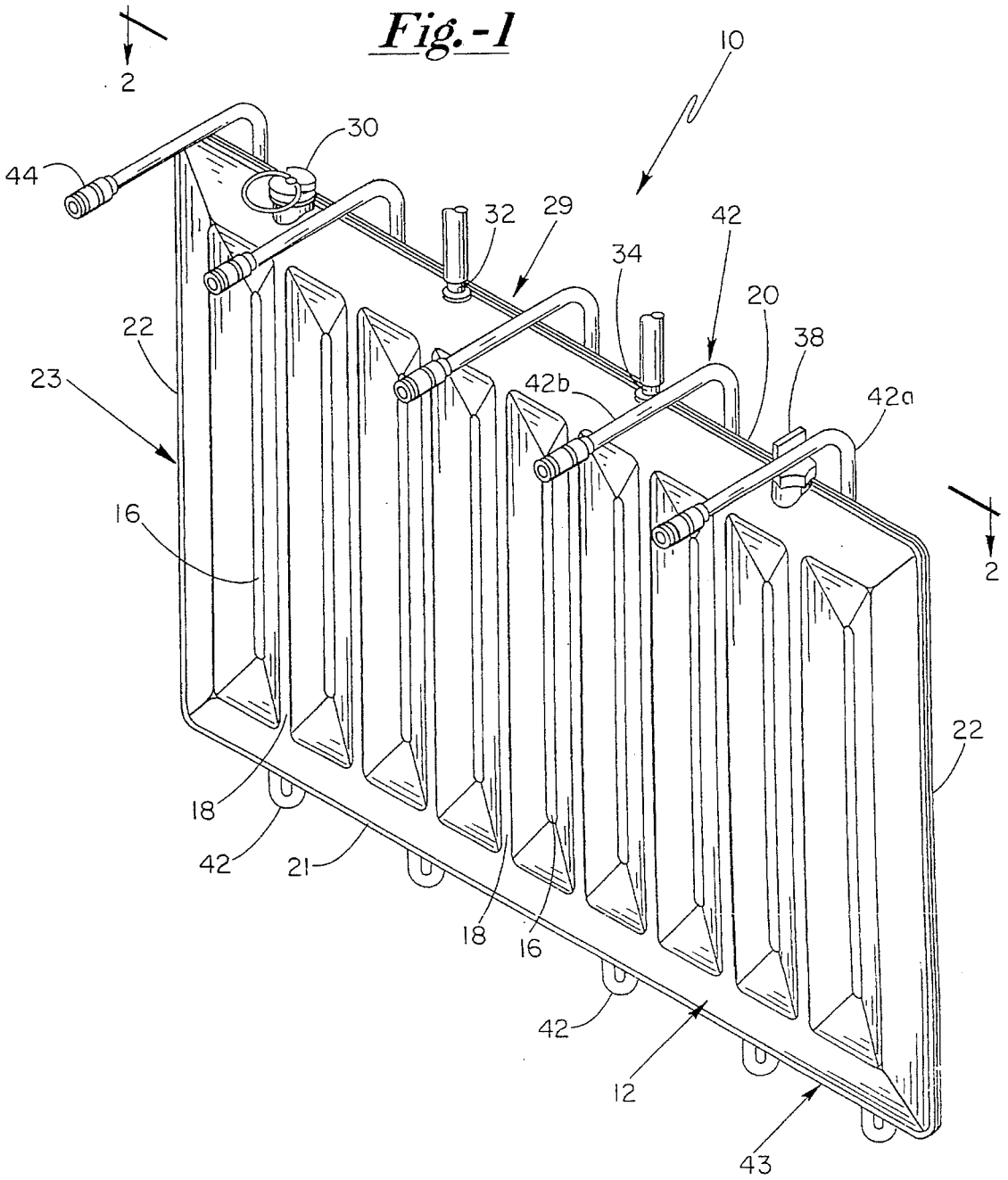
FIG. 1 shows a perspective view of the present invention.
Figure 2:
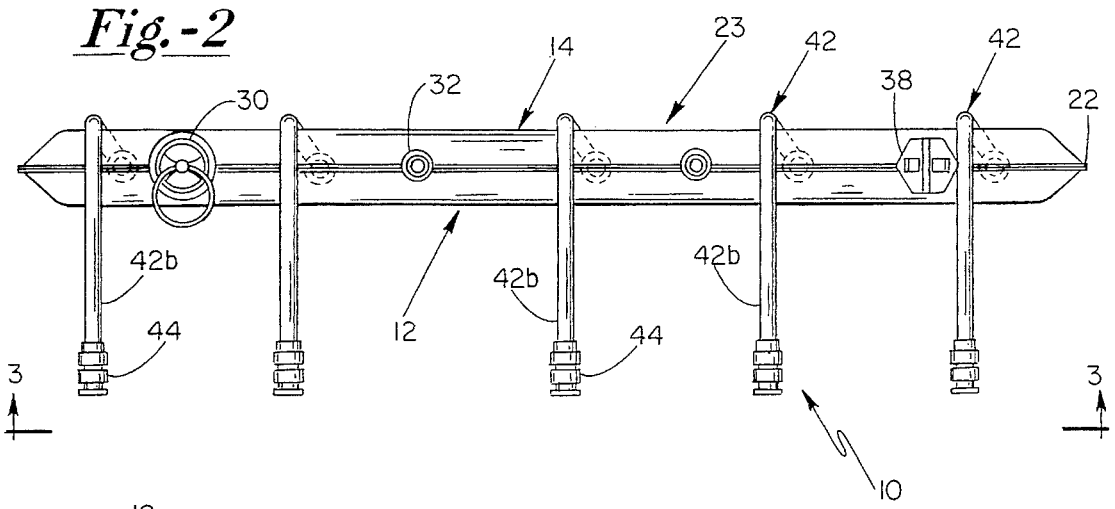
FIG. 2 shows a top plan view along lines 2—2 of FIG. 1.
Figure 3:
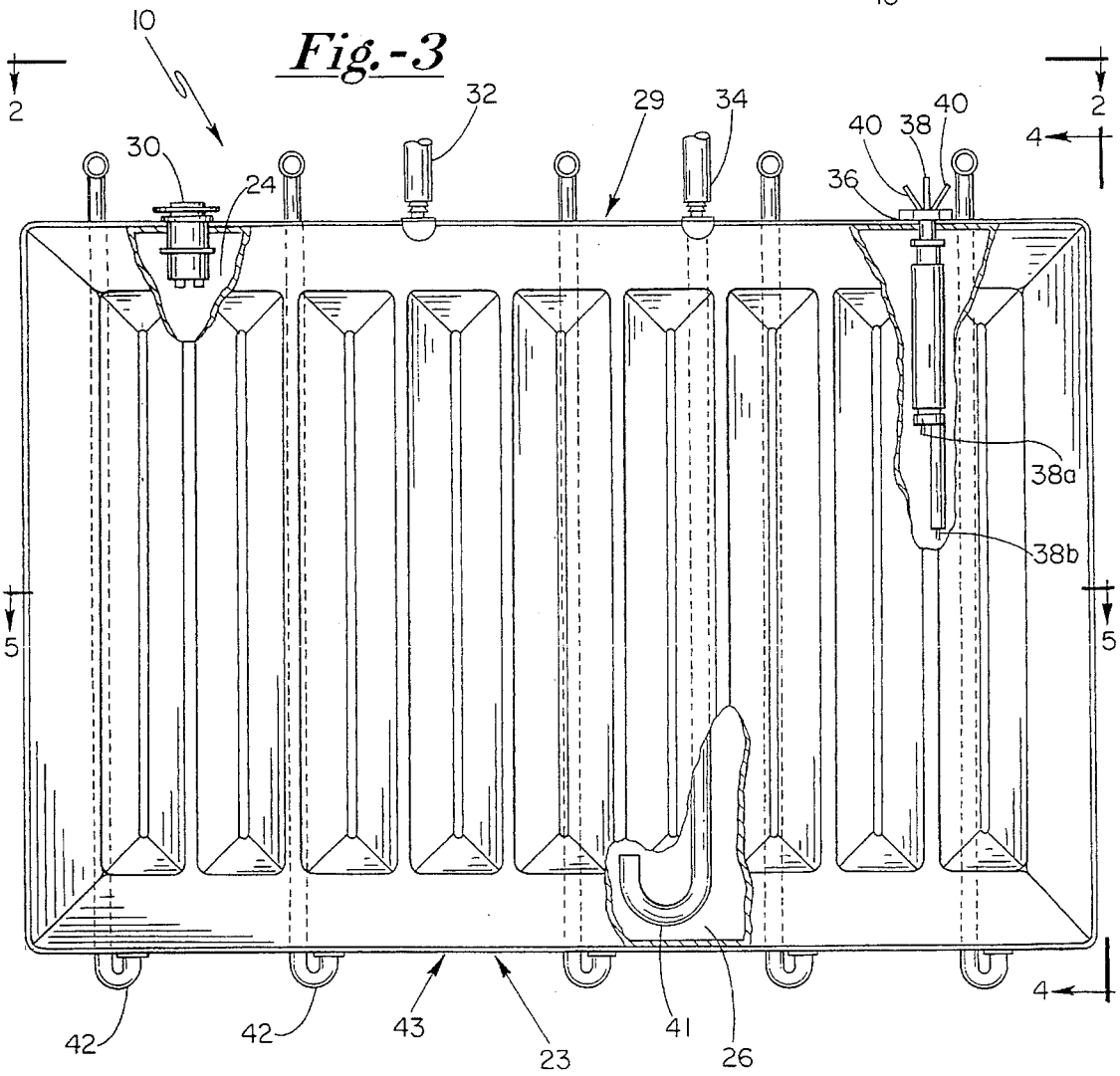
FIG. 3 shows a partial cross-sectional side plan view along lines 3—3 of FIG. 2.
Figure 4:
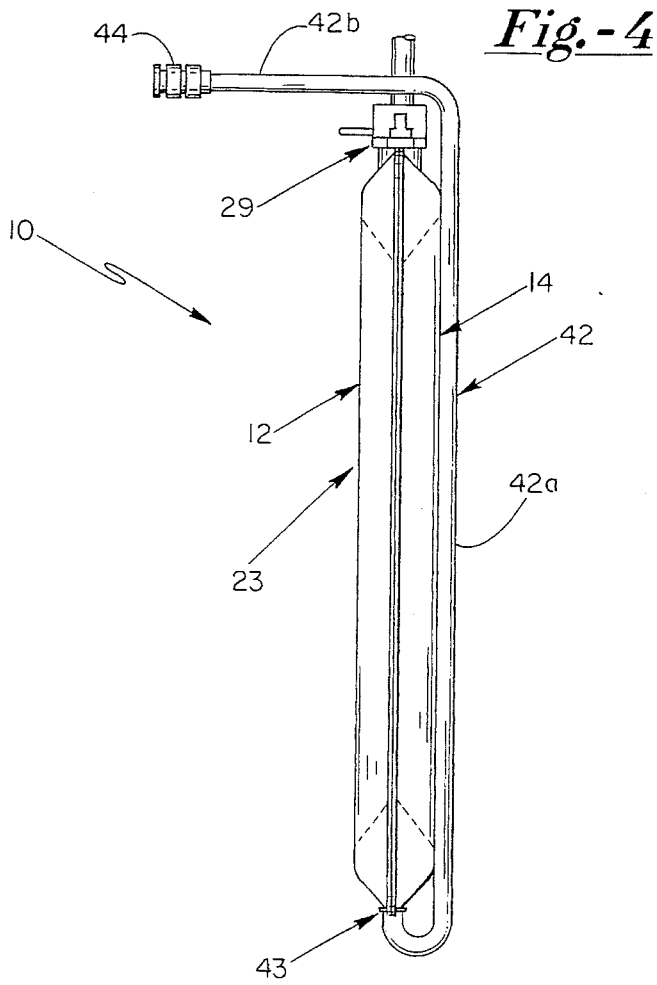
FIG. 4 shows an end plan view long lines 4—4 of FIG. 3.
Figure 5:
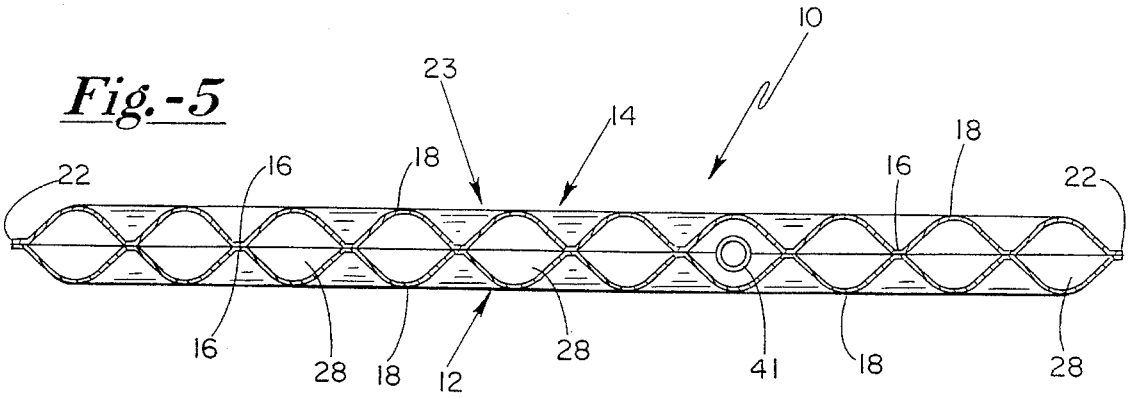
FIG. 5 shows a cross-sectional view of the present invention along lines 5—5 of FIG. 3.

The carbonator of the present invention is seen in FIGS. 1–5 and generally is referred to by the numeral 10. As seen therein, carbonator 10 includes a first half 12 and a second half 14. Halves 12 and 14 are made from a suitable sheet metal such as 18 gauge stainless steel. In particular, they are cold drawn to form an alternating pattern of seams 16 and ridges 18. Halves 12 and 14 are welded together around their respective perimeter edges having top and bottom perimeter edge portions 20 and 21 respectively and side edge portions 22, and along corresponding seams 16, to form the carbonator tank 23. It can be seen that tank 23 includes a top tank volume area 24, a bottom area 26 and a plurality of vertical column areas 28. The top and bottom areas 24 and 26 provide for fluid communication between the columns 28. A top end 29 of tank 23 includes a pressure relief valve 30, a carbon dioxide inlet fitting 32, a water inlet fitting 34 and a level sensor fitting 36 for retaining a level sensor 38. Sensor 38 includes a high level sensing contact 38*a*, and a low level sensing contact 38*b* that are connected by a pair of wires 40 to an appropriate control means. A J-tube 41 is secured to fitting 34 and extends within a column 28.

A plurality of carbonated water lines 42 extend from a bottom end 43 of tank 23 and include vertical portions 42*a* that travel upwardly closely along and adjacent a second half 14 and then extend with horizontal portions 42*b* over end 29 and outwardly therefrom in a direction towards side 12 and terminate with beverage valve fittings 44.

Figure 6:
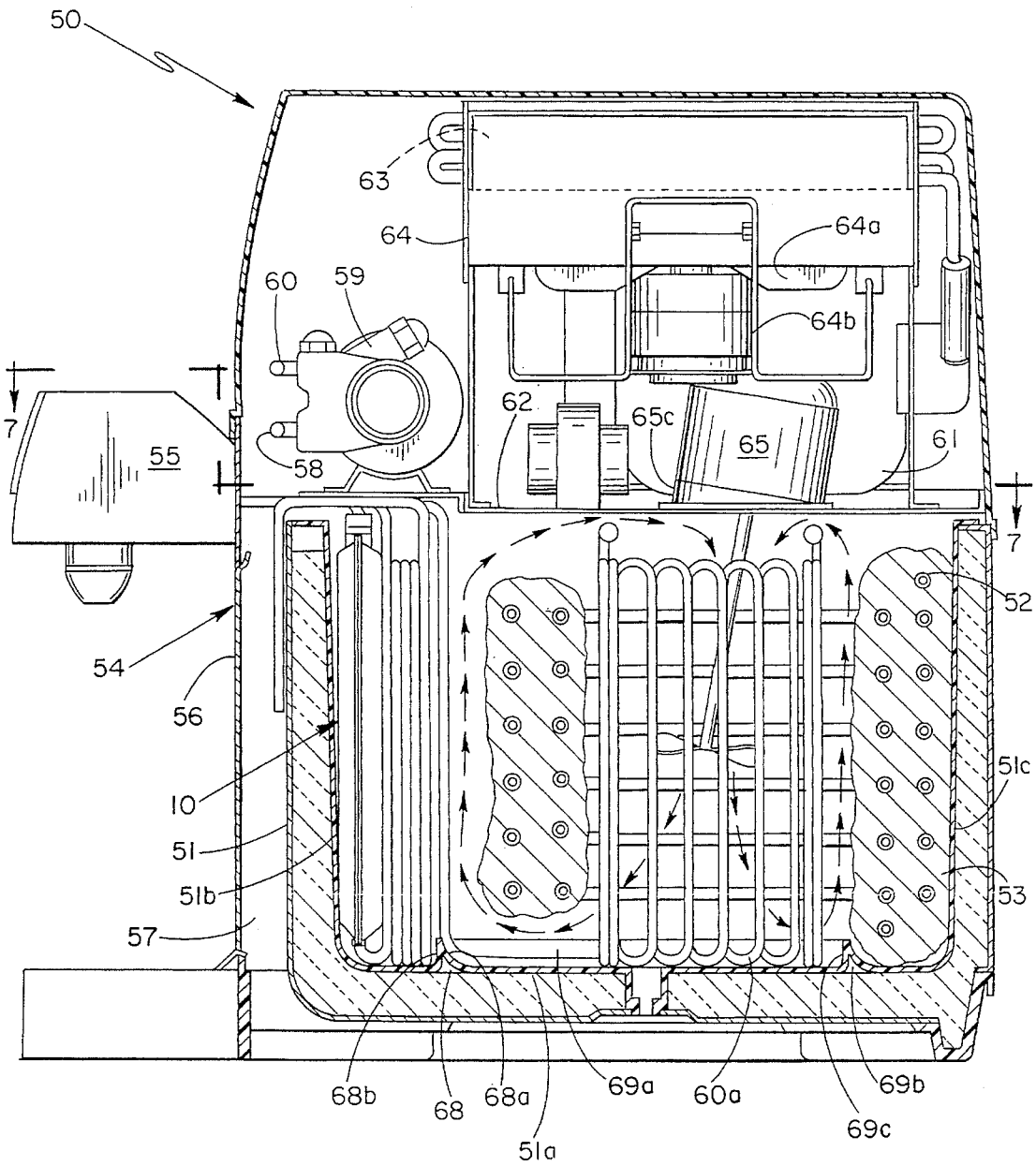
FIG. 6 shows a side plan partial cross-sectional view of an ice bank cooled beverage dispenser with the carbonator of the present invention contained therein.
Figure 7:
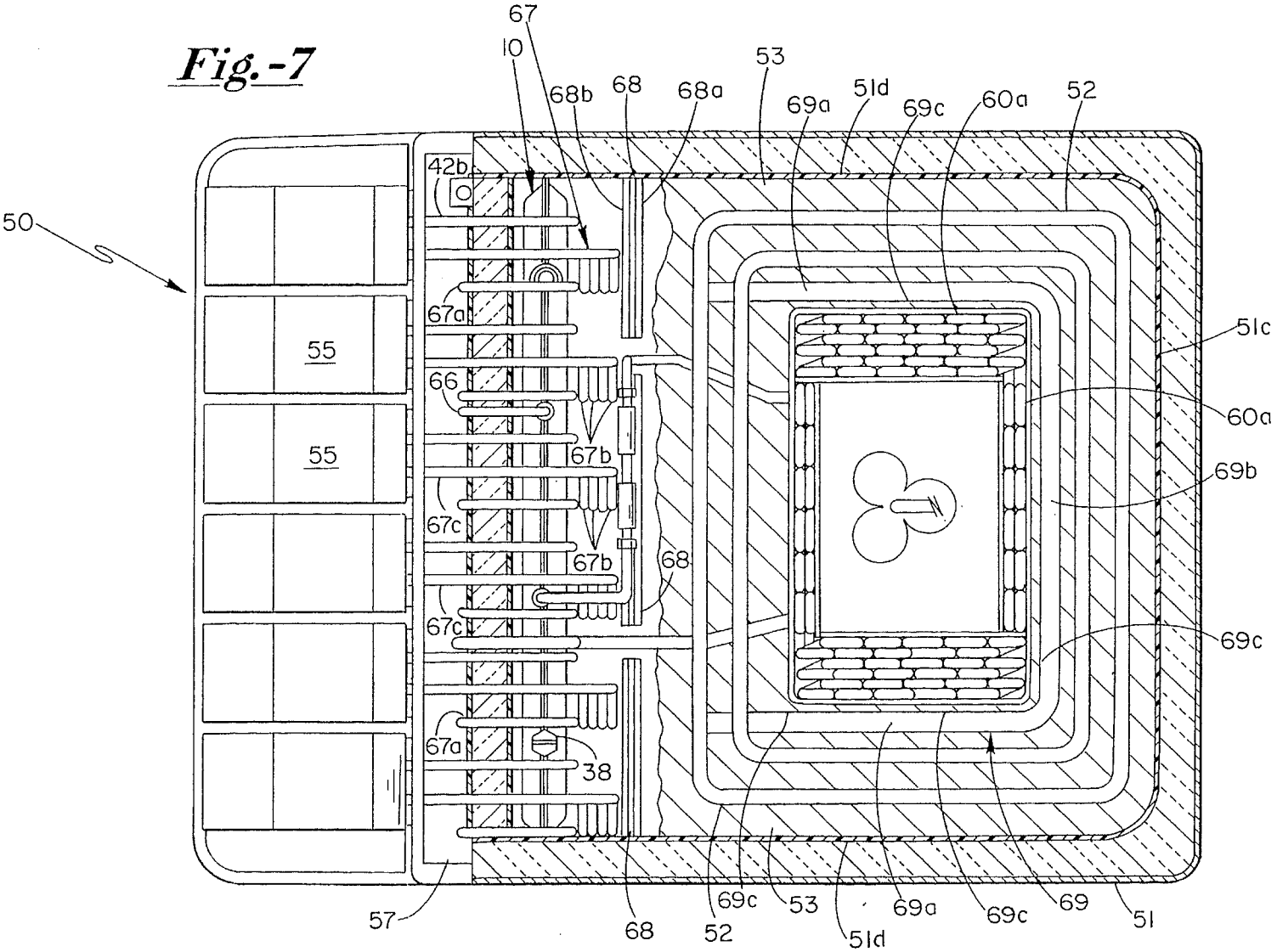
FIG. 7 shows a top plan view along lines 7—7 of FIG. 6.

As is seen by referring to FIGS. 6 and 7, carbonator 10 is shown in an ice bank type of beverage dispenser 50. As is known in the art, dispenser 50 includes an insulated water bath tank 51 having a bottom surface 51*a*, a front surface 51*b*, and rear surface 51*c* and two side surfaces 51*d*. A plurality of evaporator coils 52 are held substantially centrally within tank 51 and substantially below a surface level W of water held in tank 51 for producing an ice bank 53 thereon. Carbonator 10 is located within tank 50 and adjacent a front end 54 of dispenser 50. In particular, dispenser 50 includes a plurality of beverage dispensing valves 55 secured to the front end 54. It can be understood that carbonated water fittings 44 allow lines 42 to be hard-plumbed directly to each valve 55. Dispenser 50 also includes a removable plate 56 that provides access to a space 57 between plate and tank 50. A water delivery line 58 is connected to a source of potable water and routed through space 57 to a water pump 59. Pump 59 pumps water through a line 60 to carbonator 10. The majority of the length of line 60 consists of a serpentine coil 60*a* submerged in tank 50 to provide for cooling of the water flowing there through. Coil 60*a* is arranged in four convoluted or serpentine portions centrally of evaporator coils 52. Evaporator coils 52 are, as is known in the art, connected to a refrigeration system. Specifically, the refrigeration system main components include, a refrigeration compressor 61 secured to a top deck floor 62, a condenser 63 held by a support and air directing shroud 64 above a cooling fan 64*a* operated by a motor 64*b*. An agitator motor 65 includes a shaft 65*a* and a turbulator blade 65*b* on an end thereof, and is secured at an angle to floor 62 by an angled support 65*c*. A carbon dioxide gas delivery line 66 is routed through space 57 and is connected to gas inlet 32. Each valve 55 is connected to a syrup line 67. Lines 67 each include first portions 67*a* and are each connected to a source of syrup and are also initially routed through space 57 and then consist of a plurality of loops 67*b* positioned closely adjacent carbonator 10 in tank 51. Lines 67 then terminate by direct hard plumbing to valves 55 as the ends 67*c* thereof come up and over carbonator top end 29. Tank 51 includes a front ridge 68, and a U-shaped ridge 69, integrally molded into bottom surface 51*a* thereof. Ridge 68 includes an angled surface 68*a*, and extends across the width of tank 51 from one side 51*d* to the other. Ridge 69 has two parallel components 69*a* extending in a direction from dispenser front end 56 to the rear end opposite therefrom, and a component 69*b* perpendicular thereto and extending there between forming the "U" shape. Ridge portion 69*a* and 69*b* each include a vertical side edge portion 69*c* that extends transversely to tank bottom 51*a*.

It can be understood that carbonator 10 can be of various dimensions to fit the particular dispenser and to provide for the desired volume or capacity. In one embodiment of the present invention, carbonator 10 is substantially rectangular having a tank length, between side edges 22, of approx. 16 inches, and each column 28 has a height, between edges 20 and 21 of approx. 10.5 inches and a diameter, between corresponding ridges of halves 12 and 14, of approx. 1.25 inches, providing for an overall carbonator interior volume of approx. 65 ounces. It can be appreciated that the multiple seams 16 provide for the structural strength necessary to make a container that is relatively flat, that is, has a width that is proportionately less than the height or length thereof, and able to safely withstand the operating pressures of typically 100 pounds per square inch. Thus, carbonator 10 is designed to spread its volume over a larger surface area than standard cylindrical carbonators, but to do so in a manner that it can be efficiently packaged into a water bath with the minimum impact on the useable interior volume thereof. Moreover, it can be appreciated that the relatively large surface area of carbonator 10 provides for efficient and rapid cooling of the carbonated water contents thereof, and such surface area is enhanced by the washboard surface created by ridges 18 and seams 16.

In operation, carbonator 10 is connected to a source of pressurized carbon dioxide gas by line 66 and water enters carbonator 10, by operation of pump 59, through J-tube 41 and fills tank 23 until sensor 38*a* is in contact with the water indicating a full level at which point the control means stops the operating of pump 59. Thus, as in conventional carbonators, water is mixed with carbon dioxide gas under pressure thereby forming carbonated water. As is known, when both contacts 38*a* and 38*b* are not in contact with water the control means signals for pump 59 to operate and fill carbonator 10 with additional water until contact 38*a* is again immersed in water. It can be appreciated that the majority of the length of lines 42 are cooled directly by immersion in the water of bath 51, and only a short remainder thereof, primarily section 42*b*, extends out of the water bath. Thus, only a relatively small volume of carbonated water will be subject to warming, and such warming can be mitigated by an insulation layer over that portion of line 42 extending out of the water of bath 51. This argument also applies to syrup lines 67, as they are substantially immersed in a cold water bath. Moreover, the portions of lines 42 and coils 67*b* that extend out of bath 51 are, of course, in an air space generally cooler than that of the surrounding ambient conditions. Thus, providing the water bath has an ice bank, there will always be a good reserve of cold carbonated water, and the problem of carbonated water and syrup warming associated with a casually drawn drink, is greatly minimized.

It can also be seen that the flat carbonator 10 in combination with the particularly configured elongate oval syrup coils 67*b* lying directly adjacent and along a side thereof, form a cooling coil-carbonator structure that provides for very efficient utilization of the interior volume of tank 51. In addition, water coils 60*a* can occupy a somewhat larger percentage of the center of tank 51 than would be the case, as in prior art dispensers where the syrup coils thereof also occupy the tank center. Thus, the present invention can always provide for a large volume of cold water for carbonating, and therefore enhances the ability of dispenser 50 to provide for the dispensing of a large volume of adequately cooled drinks at high dispensing rates. A further feature of the present invention concerns the agitator motor 65 being mounted at an angle wherein water in tank is circulated in the direction indicated by the arrows in FIG. 6. Specifically the water is directed towards carbonator 10 and coils 67*b*. Such movement is enhanced by ridge 68 wherein side 68*a* thereof serves to deflect such water flow generally upwardly. Ridges 68 and 69 serve to prevent erosion of the bottom of ice bank 52 wherein surfaces 69*c* thereof serve to block any flow of water in such direction, as also seen by the arrows in FIG. 6. In this manner ice bank 53 is more evenly formed on evaporator coils 52, as opposed to having areas of erosion. An evenly formed ice bank can generally grow to be of maximum volume, hence cooling capacity, and provides for more consistent cooling operation of dispenser 50. It can be erstood that ridge 68 also serves to retain syrup coils 67*a* closely adjacent carbonator 10.

Figure 8:
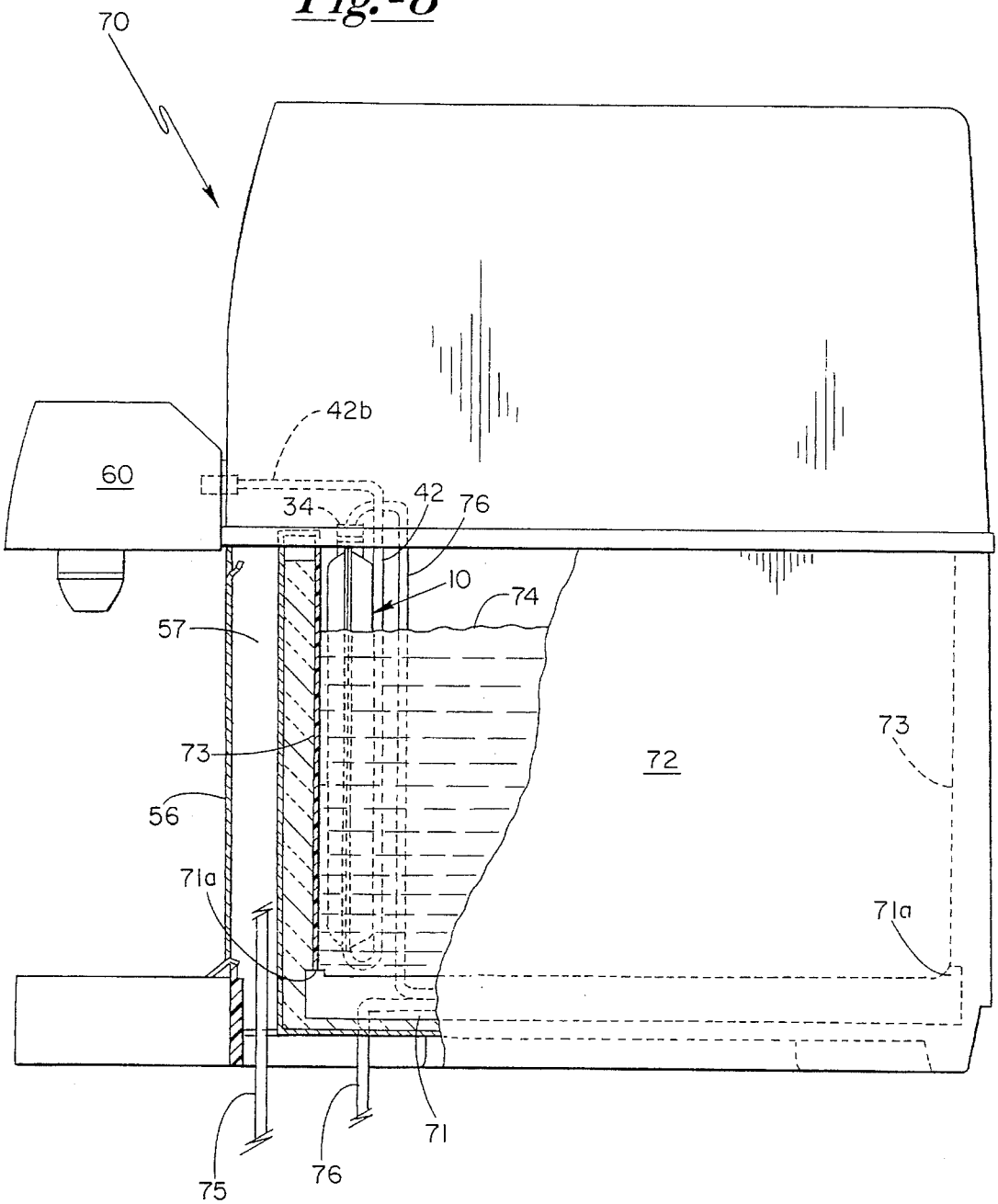
FIG. 8 shows a side plan partial cross-sectional view of an ice cooled cold plate type beverage dispenser with the carbonator of the present invention therein.

As seen in FIG. 8, a beverage dispenser 70 of the cold plate type is shown. In such a dispenser 70 a cold plate 71 is typically located at the bottom of an ice containing bin 72. An example of an ice bin and the securing thereof to a cold plate is seen in U.S. Pat. No. 4,958,505, the contents of which patent is incorporated herein by reference thereto. In particular, plate 71 includes an upturned edge 71 a to which a liner 73 is secured thereby creating in conjunction with plate 71 the ice retaining area or bin 72. Carbonator 10 can be located within bin 72 and in contact with ice 74, and lines 42, as with dispenser 50 above, directly secured to beverage dispensing valves 55. Thus, carbonator 10 also efficiently distributes its volume in an ice bin as well, and, providing there is sufficient ice therein, also greatly minimizes the effects of carbonated water warming resulting from a casually drawn drink. Dispenser 70 also includes access cover 56 and space 57. As is known in the art plate 71 includes a plurality of serpentine coils (not shown) for containing the various beverage constituents such as syrup and water for pre-cooling thereof prior to delivery to the valves 55. The dispenser 70 plate 71 includes a coil line 76 for pre-cooling flat water prior to delivery to carbonator 10. Line 76, after flowing through plate 71, can extend out of plate 71 and through bin 72 for connecting to inlet 34.

Figure 9:
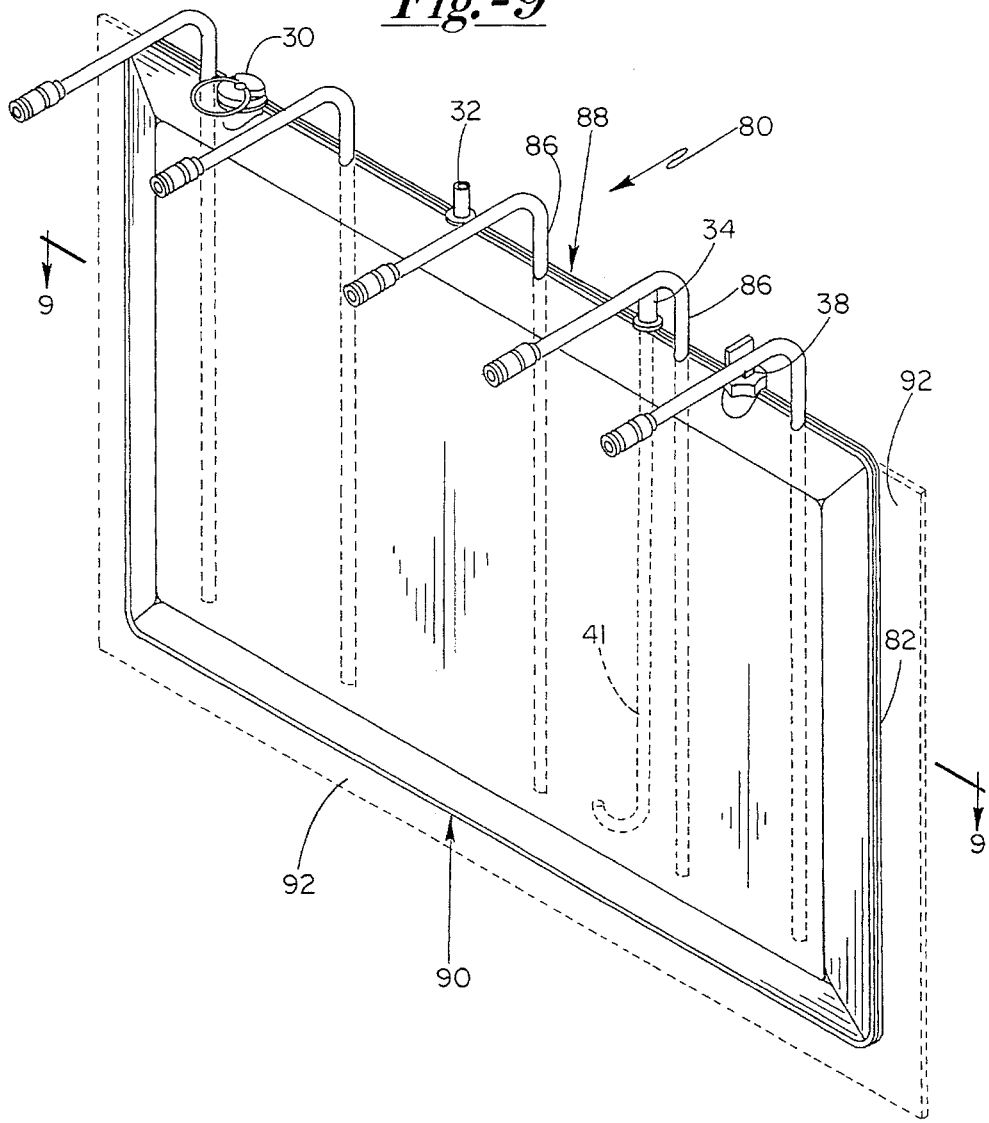
FIG. 9 shows a perspective view of a further embodiment of the carbonator of the present invention.
Figure 10:
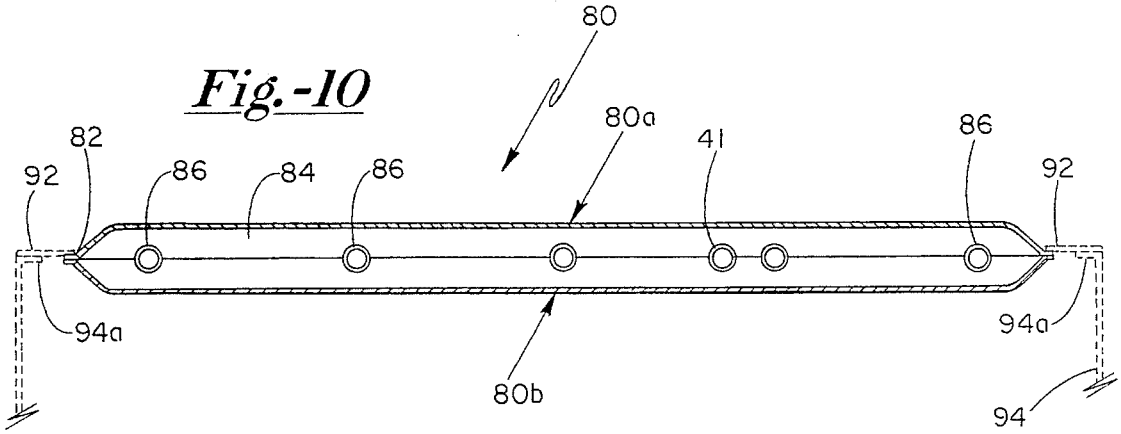
FIG. 10 shows a cross-sectional view along lines 10—10 of FIG. 9.

As seen referring to FIGS. 9 and 10, a further embodiment of the carbonator of the present invention is seen. In this embodiment carbonator 80 has halves 80*a* and 80*b* secured around a perimeter edge 82. However, unlike carbonator 10 halves 80*a* and 80*b* are not convoluted in any manner, rather they are flat. Furthermore, halves 80*a* and 80*b* are not secured together at any point or points interior of edge 82. Thus, carbonator 80 has one unobstructed interior volume space 84. Carbonator 80 includes a plurality of carbonated water lines 86. Lines 86 extend externally from top end 88 and extend internally into volume 84 terminating closely adjacent a bottom end 90. Carbonator 80 can also optionally have an extended perimeter webbing 92 around the sides and bottom thereof. Webbing 92 can be used wherein carbonator 80 forms a fourth side of a ice-bin liner. Thus, as per the ice cooled unit of FIG. 8, webbing 92 would fit into edge 71 a along the bottom thereof and an alternate liner 94, seen in FIG. 10, would be secured to the remainder of edge 71 a and to webbing 92 along flange ends 94*a* thereof. The operation of carbonator 80 is the same as that for carbonator 10 except that the carbonated water is delivered by lines 86 from the top of carbonator 80. It can be appreciated by those of skill that carbonated water lines 86 could also be used in place of lines 42 in carbonator 10. An embodiment of the present invention using lines 42 will have a little more flexibility in the connecting of such lines to the valves 55 as line 42 can be moved or bent more easily than lines 86 which are shorter and more rigid. Also, an embodiment of the present invention using the strategy of lines 42 is somewhat less complicated structurally on the top end thereof. It can be appreciated that carbonator 80 will have to be made of a thicker gauge material than carbonator 10 to withstand the same internal pressure, even in low pressure applications of 30–60 pounds per square inch useful for certain low carbonated drinks and the like.

Figure 11:
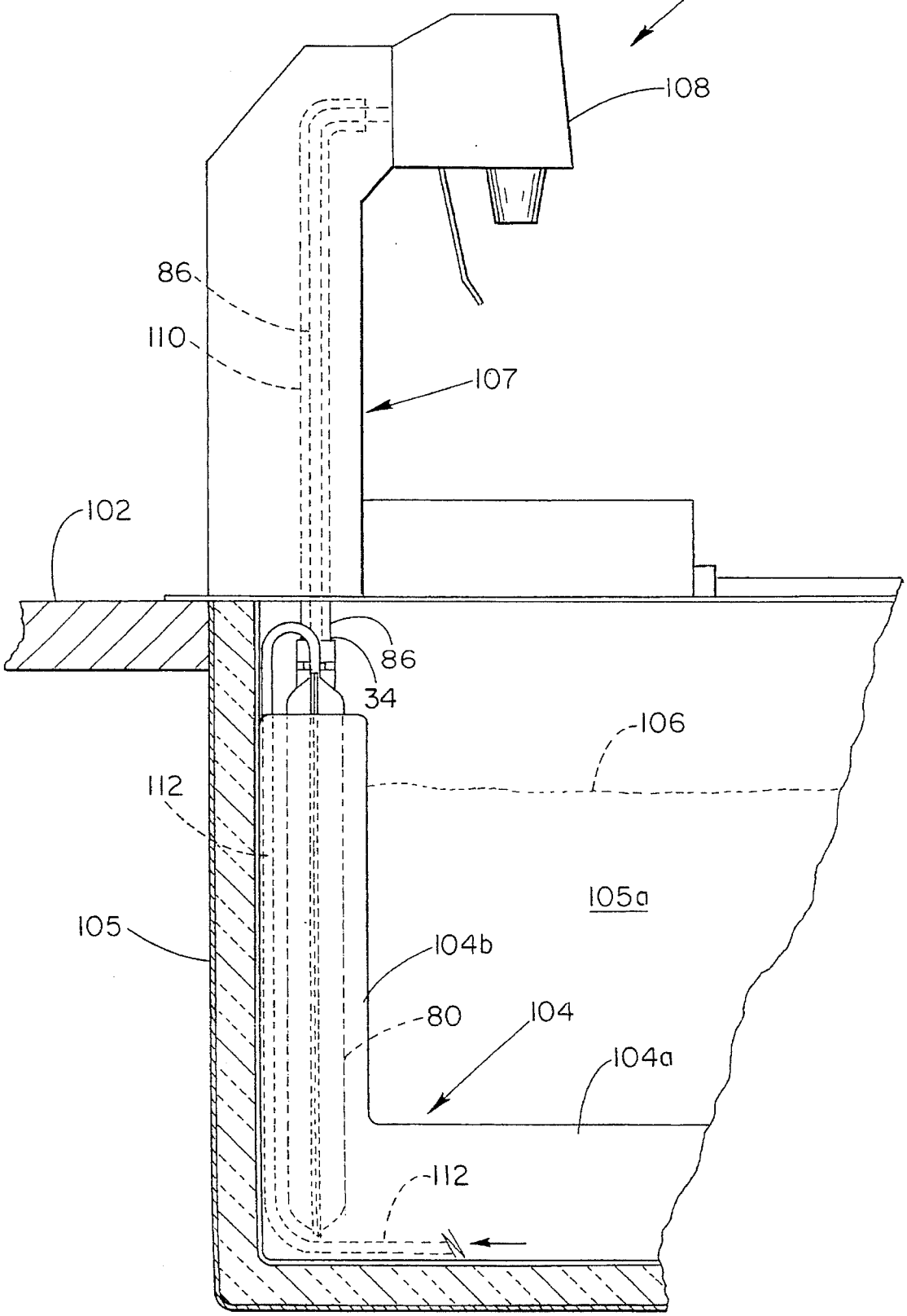
FIG. 11 shows a side plan partial cross-sectional view of a drop-in type ice cooled cold plate beverage dispenser with the carbonator embodiment of FIG. 9 retained within a vertical portion of an L-shaped cold plate.

Another strategy for pressure containment is seen by referring to FIG. 11, which shows a drop-in type beverage dispenser 100, known in the art, that is typically ice-cooled, and "dropped into" a countertop 102. Dispenser 100 includes an L-shaped cold plate 104 of the type seen in co-pending application Ser. No. 07/908,096, now U.S. Pat. No. 5,249,710, which application is incorporated herein by reference thereto. Cold plate 104 is held within an ice retaining bin 105 which defines an ice retaining space 105*a* for retaining ice 106 therein, and includes a horizontal portion 104*a* and a vertical portion 104*b*. Carbonator 80 is shown cast into vertical portion 104*b*. Thus, the cast metal, typically aluminum, when hardened, serves to provide an external means of strengthening carbonator 80 against failure as the result of high internal pressures. Lines 86 can then run directly and internally through a tower 107 for direct connection to beverage valves 108. In addition, the portion of lines 86 external of plate portion 104*b* can be insulated with a suitable insulation material 110. As is known, plate 104*a* includes serpentine coils of tubing for cooling beverage constituents. A coil line 112 is connected to a source of potable water and a water pump, (not shown) and first extends through plate 104*a* and then upwardly through plate portion 104*b* for ultimate connection to water inlet 34. A carbon dioxide gas line, (not shown), is routed through bin 105 and space 105*a* for connection to inlet 32 of carbonator 80. In operation, carbonator 80 of dispenser 100 is cooled by heat exchange with ice contained within bin 105 and thereby efficiently and rapidly cools the carbonated water therein. Also, as the lines 86 are cooled by heat exchange with portion 104*b* and are themselves insulated, unwanted heating as the result of infrequent drink dispensing is greatly reduced.

It can be appreciated that carbonators 10 and 80 could be interchanged in the various applications shown herein, and the lines 42 and 86 could be interchanged. Furthermore, it can be understood that carbonators 10 and 80 eliminate the need for a carbonated water manifold structure typically found adjacent the dispensing valves of a beverage dispenser. Such a manifold structure typically receives carbonated water from a carbonator along one line and then has a plurality of outlets for delivering the carbonated water individually to each valve. Since carbonators 10 or 80 provide such individual delivery lines such a manifold structure is not needed. It can also be appreciated by those of skill in the art that various modifications can be made to the present invention without exceeding the scope and inventive concept thereof. For example, the number of alternating seams and ridges or the orientation and pattern thereof can be varied. Thus, seams 16 and their associated welds need not be along straight lines or lines at all, for that matter. The internal joining of halves 12 and 14 could be accomplished by any plurality of individual points or other welding patterns that sufficiently secure them together to provide for a tank that can safely withstand the intended operating pressures. In addition, carbonators made in accordance with the present invention need not be rectangular as depicted but could be of various shapes as defined by the perimeter thereof, provided the overall length and height thereof is substantially greater than the width thereof so that the carbonator is relatively flat or narrow in its width dimension in proportion to its length and height. Also, it can be appreciated that carbonators 10 or 80 can be located in different positions and orientations within a water bath or ice bin of a beverage dispensing device, and, of course, can be used externally of a beverage dispensing device. For example, carbonator 80 could be oriented substantially horizontally at a shallow angle at the bottom of dispenser bin 72 above or below plate 71. The shallow angle would provide for a space at "top" end 29 so that a pressure head gas space could be maintained. Of course, any level sensor used therein may have to be modified to account for the changed high and low water sensing operation that would be occasioned by such a substantially horizontal orientation.

Figure 12:
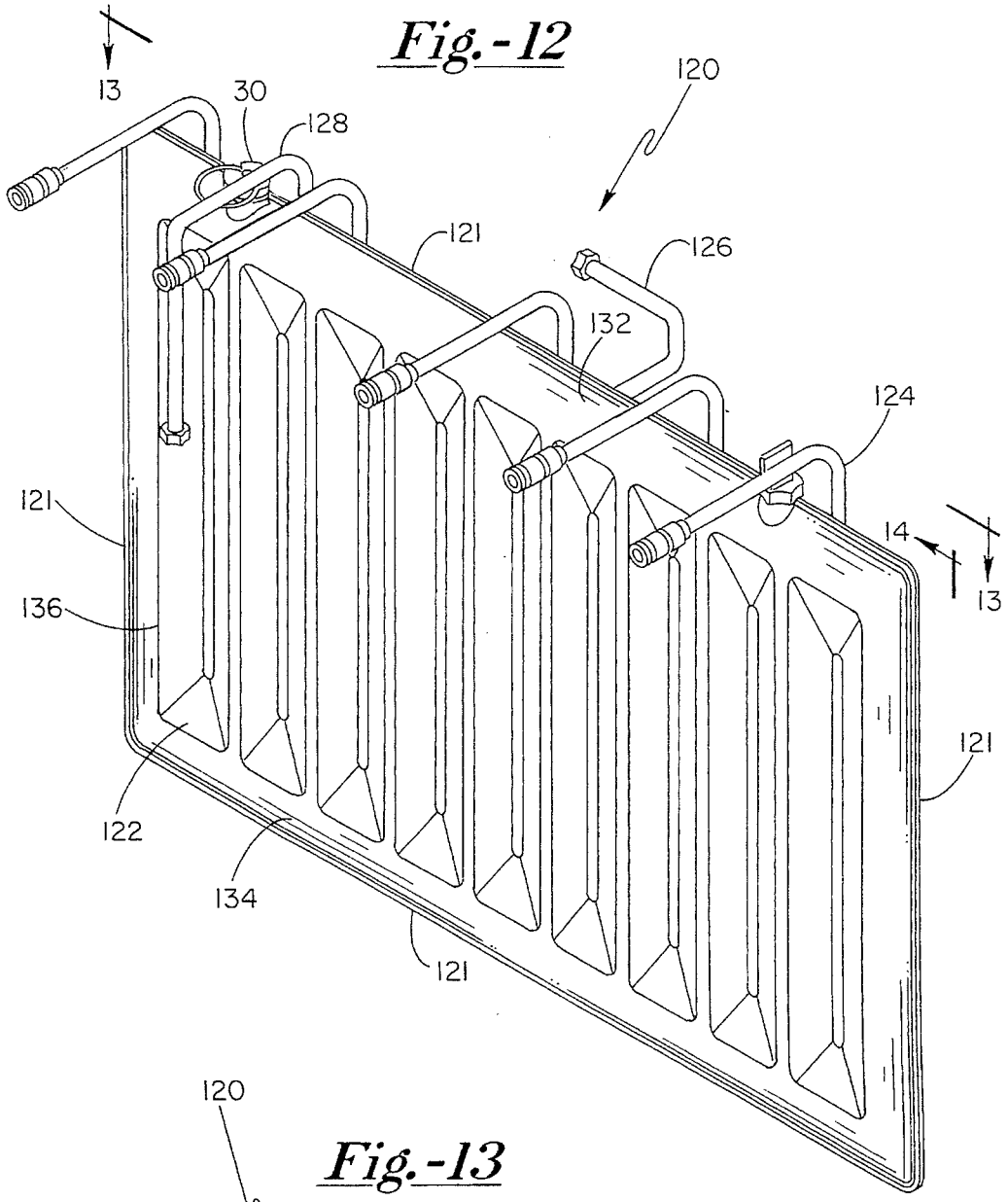
FIG. 12 shows a perspective view of a further embodiment of the carbonator of the present invention.
Figure 13:
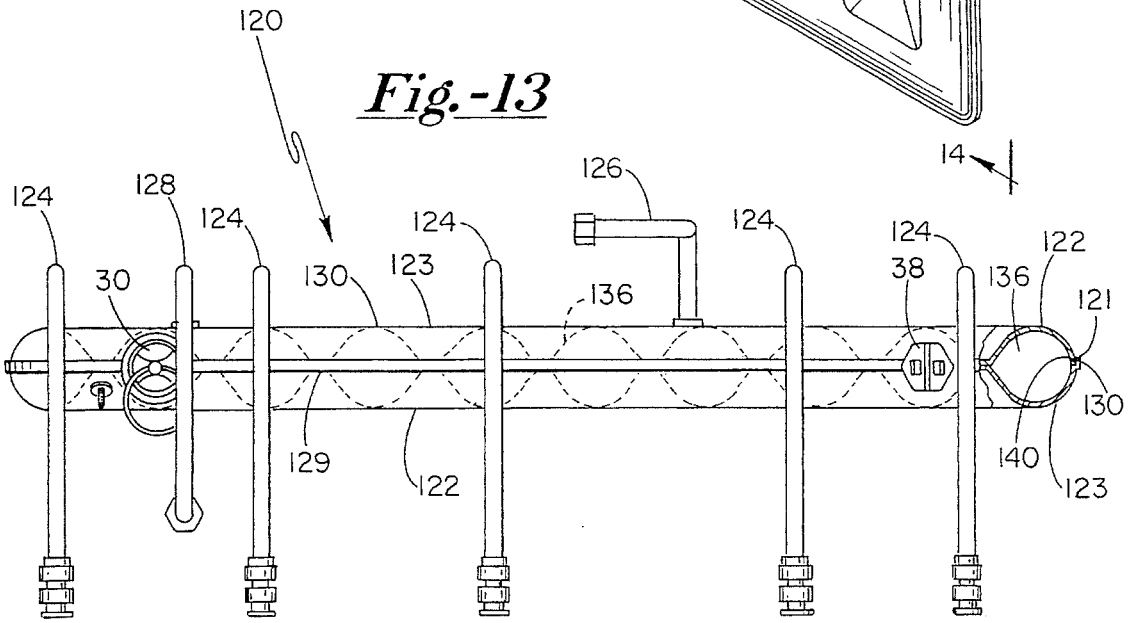
FIG. 13 shows a partial cross-sectional top plan view along lines 13—13 of FIG. 12.
Figure 14:
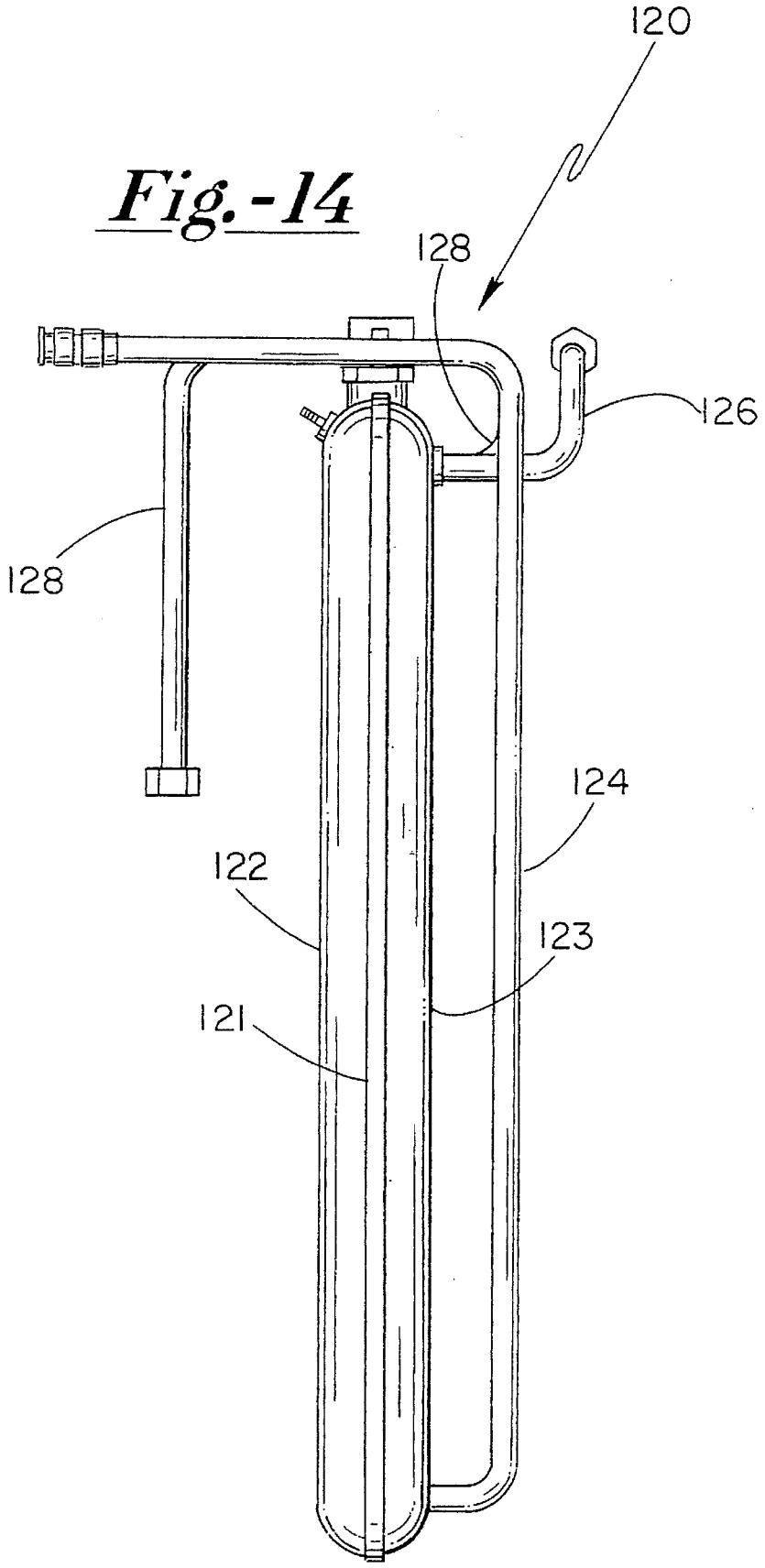
FIG. 14 shows a side plan view along lines 14—14 of FIG. 12.

A further embodiment of the carbonator of the present invention is seen in FIGS. 12, 13 and 14, and generally referred to by the numeral 120. Carbonator 120 is basically the same as carbonator 10 with the exception that it has two structural improvements that provide for increased resistance to failure in high pressure applications. Carbonator 120 has a perimeter seam 121, front and rear sides 122 and 123, and includes five carbonated water delivery lines 124, a plain water inlet line 126 and a carbon dioxide gas inlet line 128. Carbonator 120 also has the same "washboard" structure of alternating valleys 129 and ridges 130, such that when welded together, form upper and lower tank volumes 132 and 134 and a plurality of vertical tank columns 136. In particular, perimeter seam 121 is formed by the welding of overlapping edges 138 and 140 of sides 122 and 123.

It can be seen that lines 124, 126 and. 128 extend laterally from rear side 123 from upper and lower tank volumes 132 and 133. This structure is in contrast to what is seen in the previously described carbonators wherein the counterpart inlet and delivery lines thereof exit directly from the perimeter rims thereof. Such securing of lines 124, 126 and 128 is easier, from a manufacturing point of view, than forming such connections in a welded seam, and are less likely to fail or leak due to pressure. In addition, the overlap of seam 121 provides for greater strength. As with the previous carbonators disclosed herein, corresponding valleys 129 of carbonator 120 can be welded together using resistance welding, whereas the welding of seam 12 1 is preferably done using TIG welding. Also, as is known in the art, a post welding heat annealing process can serve to further insure against pressure failures of carbonator 120.

I claim:

1. An ice cooled beverage dispenser comprising:

a cold plate, the cold plate being L-shaped and having a horizontal portion and a vertical portion, the cold plate for cooling beverage fluids by heat exchange with ice, the beverage fluids flowing through beverage lines extending through the cold plate from beverage sources to one or more beverage dispensing means, a bin liner comprising a U-shaped wall segment secured to and extending upward from and around a perimeter edge of the cold plate horizontal portion, and the bin liner having opposing vertical edges for securing to opposing end edges of the cold plate vertical portion whereby the bin liner and the cold plate define an ice retaining volume, and a carbonator, the carbonator having a first side, and a second side, and the first and second sides being substantially planar with co-extensive surface areas wherein common perimeter edges thereof are joined to form a carbonator perimeter edge, and the first side closely spaced from the second side defining a width dimension wherein the carbonator comprises a substantially flat container wherein length and height dimensions of the first and second sides are substantially greater than the width dimension, and the carbonator having an interior volume defined by the first and second sides and the carbonator perimeter edge, and the carbonator having a gas inlet fitting for connecting the internal volume thereof to a source of carbon dioxide gas, a water inlet fitting for connecting the carbonator internal volume to a source of potable water, and one or more carbonated water outlet fittings for providing connection from the carbonator interior volume to the one or more beverage dispensing means, and the carbonator held within the cold plate vertical portion.

2. The dispenser as defined in claim 1, and the carbonator substantially fully contained within the cold plate vertical portion.

3. The dispenser as defined in claim 2, and the carbonator further including a plurality of points within the carbonator perimeter edge at which the first side is secured to the second side for defining a plurality of carbonator internal volume areas, and the volume areas in fluid communication with each other.

4. The dispenser as defined in claim 3, and the carbonator perimeter edge having first and second end portions opposite from each other, and the first and second carbonator sides each having a plurality of corresponding and alternating ridges and seams, and the seams extending partially along a length of each first and second side between the first and second perimeter edge portions and the seams secured together along a portion of their corresponding lengths for defining a plurality of elongate interior volumes fluidly connected by first and second volumes extending adjacent the first and second side ends transverse to the extension of the interior volumes.

5. The dispenser as defined in claim 1, and the one or more carbonated water fittings comprising rigid tubes integral with the carbonator and extending therefrom for providing direct connecting to the one or more beverage dispensing means.

6. The dispenser as defined in claim 5, and the rigid tubes extending from a bottom portion of the carbonator perimeter edge and extending closely adjacent one of the carbonator sides and terminating at a point adjacent a top portion of the carbonator perimeter edge.

7. The dispenser as defined in claim 1, and the carbonator further including a plurality of points within the carbonator perimeter edge at which the first side is secured to the second side for defining a plurality of carbonator internal volume areas, and the volume areas in fluid communication with each other.

8. The dispenser as defined in claim 7, and the carbonator perimeter edge having first and second end portions opposite from each other, and the first and second carbonator sides each having a plurality of corresponding and alternating ridges and seams, and the seams extending partially along a length of each first and second side between the first and second perimeter edge portions and the seams secured together along a portion of their corresponding lengths for defining a plurality of elongate interior volumes fluidly connected by first and second volumes extending adjacent the first and second side ends transverse to the extension of the interior volumes.

9. The dispenser as defined in claim 8, and the carbonator substantially fully contained within the cold plate vertical portion.

10. The dispenser as defined in claim 8, and the one or more carbonated water fittings comprising rigid tubes integral with the carbonator and extending therefrom for providing direct connecting to the one or more beverage dispensing means.

11. The dispenser as defined in claim 10, and the rigid tubes extending from a bottom portion of the carbonator perimeter edge and extending closely adjacent one of the carbonator sides and terminating at a point adjacent a top portion of the carbonator perimeter edge.

* * * * *